US005573437A

United States Patent [19]

Van Dyke et al.

[11] Patent Number: 5,573,437

[45] Date of Patent: Nov. 12, 1996

[54] PACKAGED BALLOON AND GREETING CARD

[75] Inventors: Mark J. Van Dyke, Mundelein, Ill.; Ernst R. Reiter, Temse, Belgium

[73] Assignee: CTI Industries Corporation, Barrington, Ill.

[21] Appl. No.: 217,185

[22] Filed: Mar. 23, 1994

Related U.S. Application Data

[63] Continuation of Ser. No. 59,054, May 6, 1993, abandoned, which is a continuation-in-part of Ser. No. 908,287, Jul. 2, 1992, abandoned.

[51] Int. Cl.[6] ..... A63H 33/04; A63H 33/16; A63H 3/06

[52] U.S. Cl. ..... 446/75; 446/71; 446/176; 446/220; 446/79

[58] Field of Search ..... 446/220–226, 446/71, 75, 79, 80, 176

[56] References Cited

U.S. PATENT DOCUMENTS

| | | | |
|---|---|---|---|
| D. 259,573 | 6/1981 | Renaud . | |
| 1,208,232 | 12/1916 | Taylor . | |
| 2,635,386 | 4/1953 | Guischard . | |
| 3,191,801 | 6/1965 | Standish . | |
| 4,305,501 | 12/1981 | Collette . | |
| 4,758,198 | 7/1988 | Ishiwa | 446/220 |
| 4,903,958 | 2/1990 | DiCarlo et al. | 272/27 |
| 4,936,460 | 6/1990 | Meyer | 446/75 |
| 5,108,339 | 4/1992 | Kieves | 446/221 |
| 5,334,072 | 8/1994 | Epstein | 446/224 |
| 5,514,022 | 5/1996 | Harris | 446/75 |

FOREIGN PATENT DOCUMENTS

| | | | |
|---|---|---|---|
| 0220827 | 5/1987 | European Pat. Off. | B42D 15/04 |
| 2621864 | 10/1987 | France . | |
| 854768 | 11/1952 | Germany | 446/220 |
| 3916701A1 | 11/1990 | Germany . | |

OTHER PUBLICATIONS

"Onepack" Product, M&D Balloons, Inc., of Manteno, Illinois; earliest introduction date of said product known by applicants being Mar. of 1993.

*Primary Examiner*—Robert A. Hafer
*Assistant Examiner*—Jeffrey D. Carlson
*Attorney, Agent, or Firm*—Tilton, Fallon, Lungmus & Chestnut

[57] ABSTRACT

A packaged balloon and greeting card are disclosed comprising a balloon having an uninflated body, a filler neck extending from said body, and a first image displayed on said body; a greeting card having a face displaying a second image matching the first image; a tether line having a first end attached to the filler neck and a second end attached to the greeting card; and a packaging envelope receiving the uninflated balloon body, the greeting card, and at least a portion of the tether line. A third image, matching the first and second image, can be displayed on the envelope. The packaging envelope can also include an opening through which the balloon filler neck extends outside the envelope for communication to a source of inflating gas to permit in-situ inflation of the balloon body in the envelope. The envelope can also be constructed so as to be burst by inflation of the uninflated balloon body while it resides in the envelope to facilitate unpackaging of the balloon for use.

20 Claims, 4 Drawing Sheets

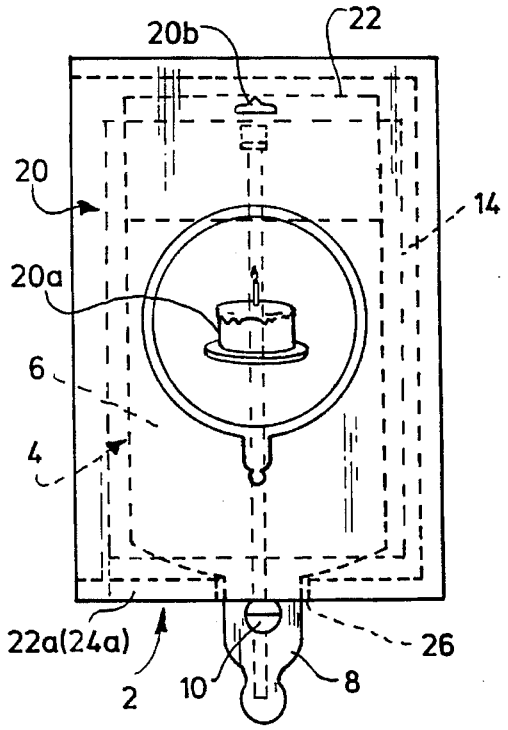
Fig. 1
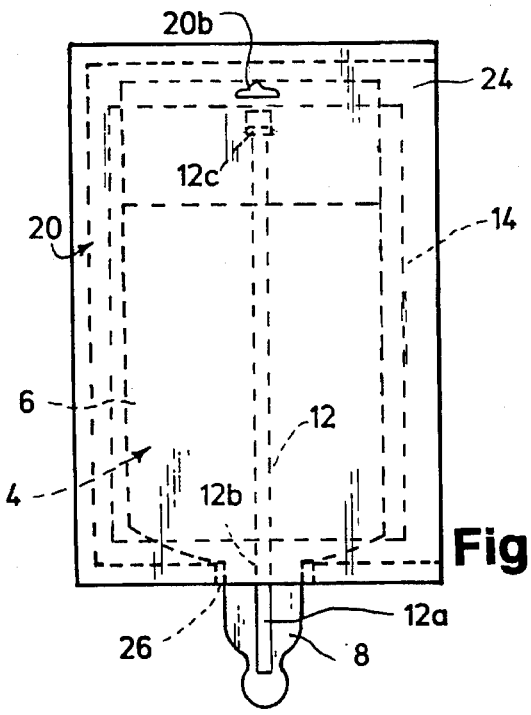
Fig. 2
Fig. 3
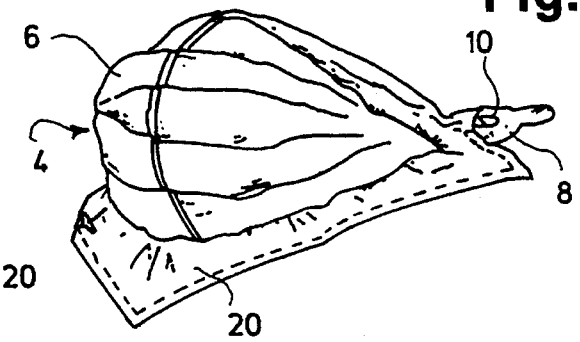
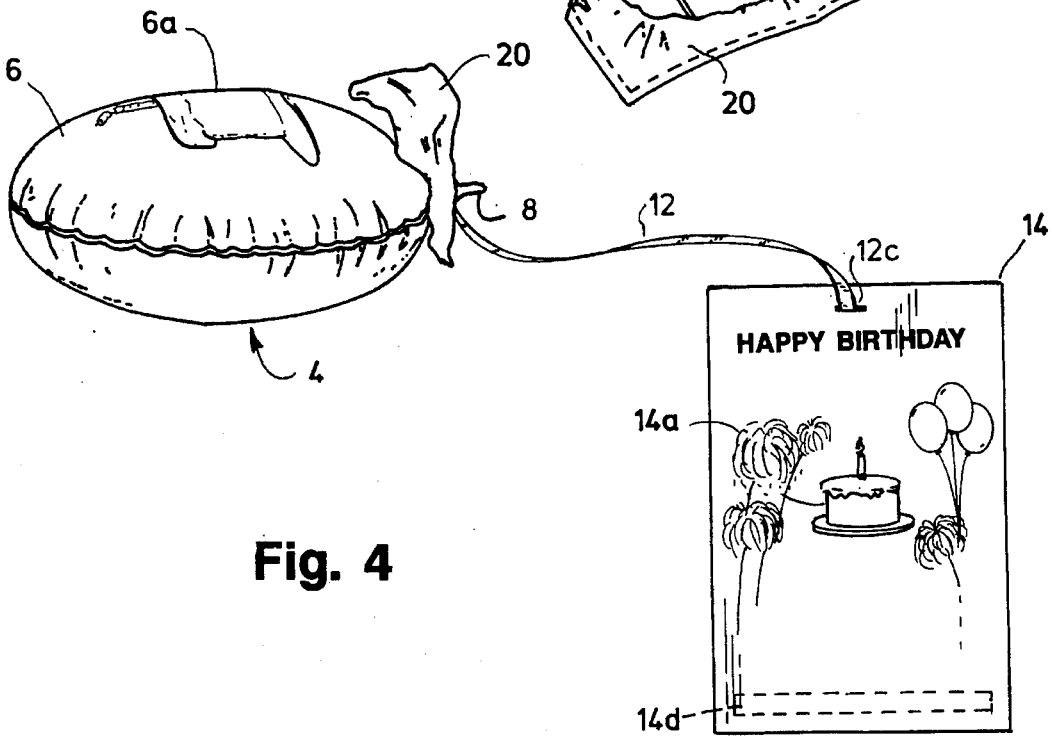
Fig. 4

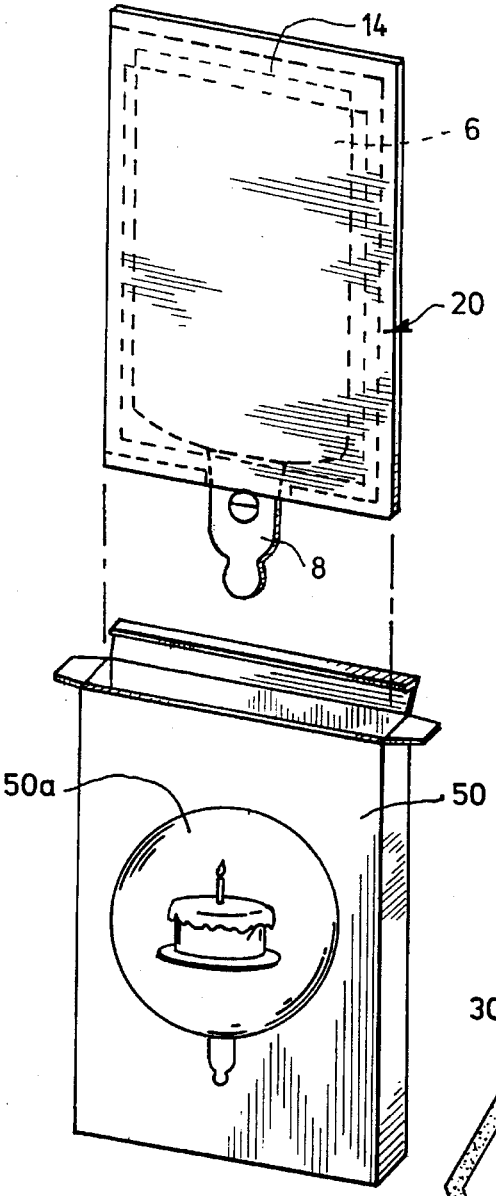
Fig. 5
Fig. 7
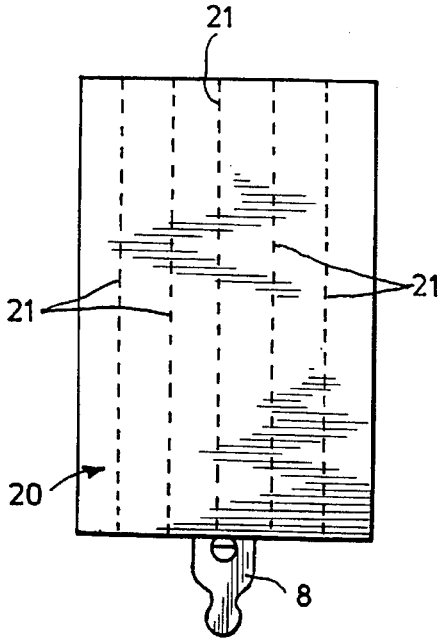
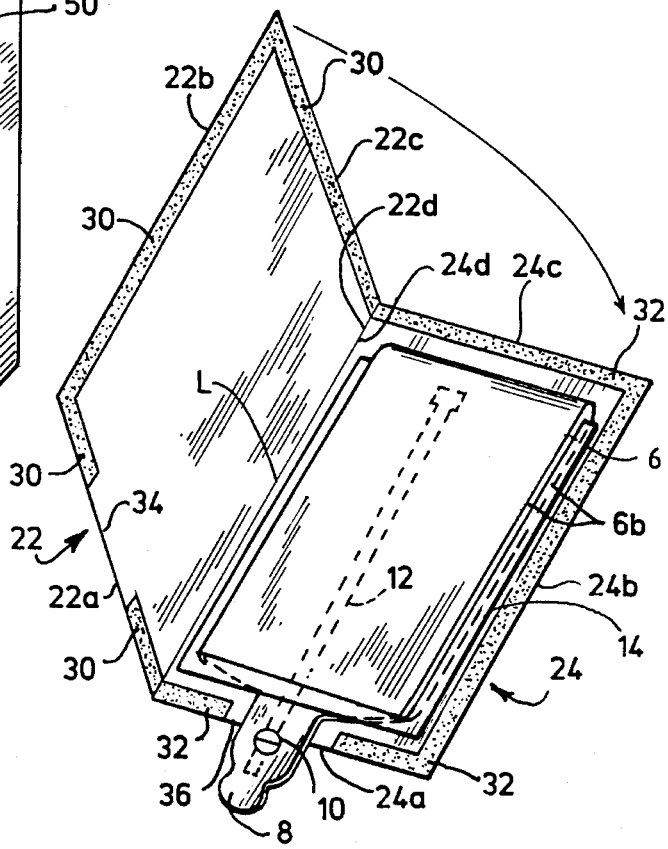
Fig. 6

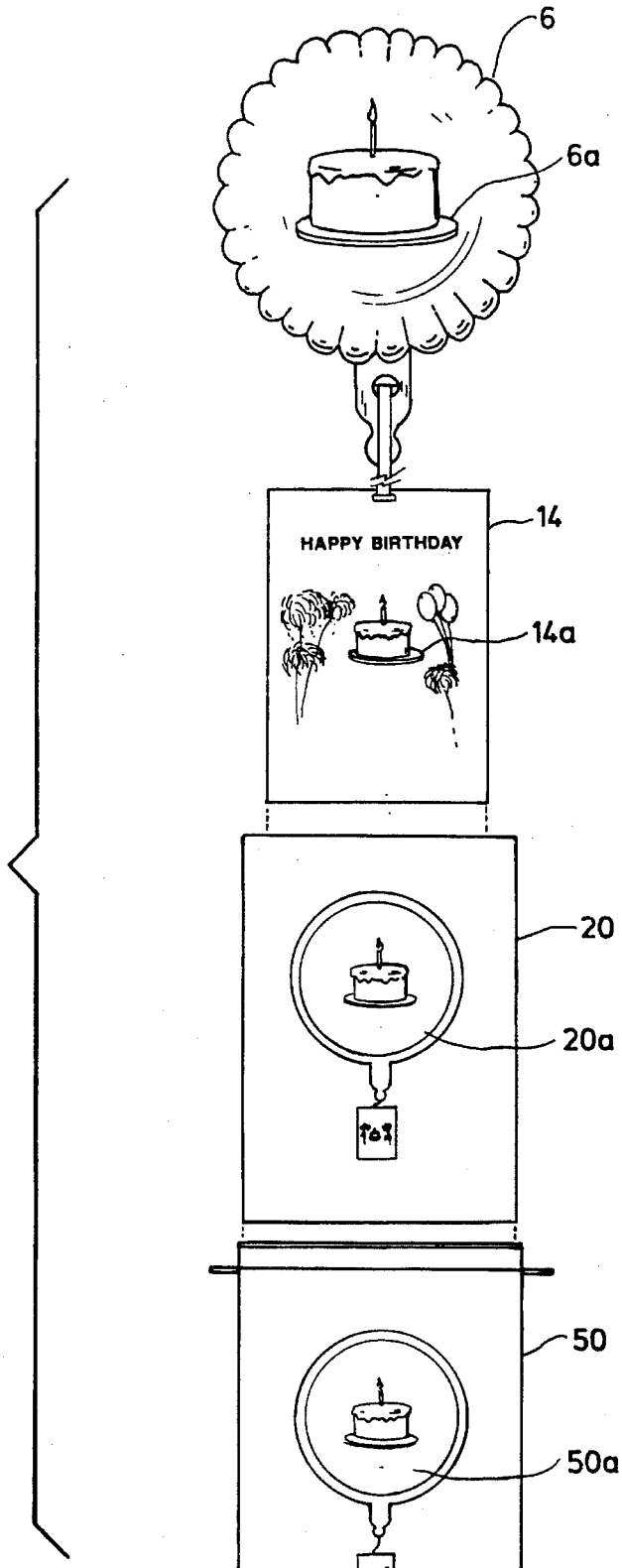
Fig. 9
Fig. 8
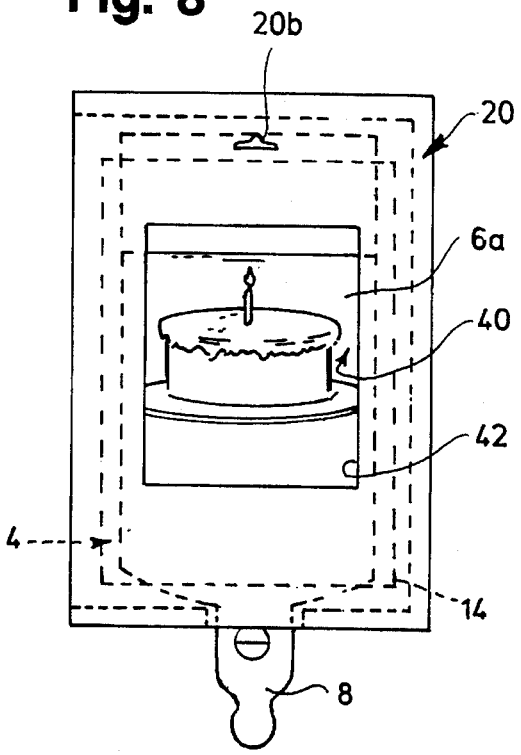

PACKAGED BALLOON AND GREETING CARD

FIELD OF THE INVENTION

This application is a continuation of U.S. patent application Ser. No. 08/059,054, filed May 6, 1993, now abandoned, which is a continuation-in-part of U.S. patent application Ser. No. 07/908,287, filed Jul. 2, 1992, now abandoned.

The present invention relates to the packaging of an uninflated balloon and greeting card in a packaging envelope in a manner that is advantageous for shipping, storing and displaying of the balloon and greeting card to potential purchasers.

BACKGROUND OF THE INVENTION

Metallized plastic, i.e., non-latex, balloons are well known (e.g., see U.S. Pat. No. 4,077,588) and sold in large numbers throughout the world. The popularity of metallized plastic balloons is attributable in large part to the eye-catching "shiny" metallized appearance of the balloon as well as the myriad graphic designs that have been applied to one or both sides of the balloon.

Manufacturers of metallized plastic balloons typically ship the balloons to customers throughout the world using conventional shipping procedures wherein a selected number of balloons are stacked flat and packed in a suitable container, such as a cardboard box, for transport to the customer's location (e.g., a retail store). The balloons are packed in the container without any protective wrap or packaging about each individual balloon.

At the retail store, the balloons are unpacked for display to potential retail purchasers, or placed in closed storage trays. Often times, a single "sample" balloon is removed from the container for display in a conspicuous manner on a display rack, wall or other display area in the retail store. Typically, different types and styles of metallized balloons are placed on display. The potential purchaser can thereby view the respective balloons and select a particular one for purchase. However, in this situation, the purchaser usually cannot remove the selected "sample" balloon on display but, instead, must seek the assistance of a sales clerk who will provide the selected balloon from available inventory, whether in storage racks or trays or otherwise, and inflate it for the purchaser. If desired by the customer, the sales clerk also may attach a tether line to the filler neck of the selected, inflated balloon. A suitable weight is sometimes attached to the free end of the tether line. The tether line and balloon weight usually are maintained in separate inventory and locations at the retail store.

Non-metallized, so-called latex balloons are also sold and shipped in large numbers throughout the world using similar shipping procedures. At retail stores, latex balloons typically are displayed en masse in an open container so that a purchaser can simply pick the balloons from the container for purchase. Tether lines and weights for such latex balloons typically are also sold from separate inventories at the retail store.

Shipping, storage and display of balloons at the retail store in the manner described above subject the balloons to accumulation of dirt and to possible damage from handling. Metallized plastic balloons are especially prone to physical damage from handling, such as puncture, as a result of the relatively fragile nature of the materials employed in their construction. Moreover, any accumulation of dirt or wearing off of the printed graphics on these balloons detracts from their "shiny" metallized appearance.

In the past, retail stores have sold greeting cards with graphics or logos that correlated with corresponding graphics or logos on certain balloons. However, those greeting cards were made by a different entity, shipped separately from the corresponding balloons, and sold in separate locations in the store. Thus, consumers were often not aware that coordinated balloons and greeting cards were even available and the sales of such matching balloons and cards proved to be quite unsuccessful.

Accordingly, an object of the present invention is to provide a packaged balloon and greeting card wherein an individual balloon, an associated balloon tether line, and a greeting card with matching graphics are packaged together in a packaging envelope for convenient shipment, storage and display as a composite unit.

Another object of the present invention is to provide a packaged balloon and greeting card wherein an individual balloon and card are packaged in a packaging envelope in a manner that protects the balloon and card from dirt and damage during shipping, storage and display to potential purchasers at retail locations.

A further object of the present invention is to provide a balloon and greeting card combination wherein the greeting card acts as a protective cover for the balloon during shipping, storage and display to potential customers.

Still another object of the present invention is to provide a packaged balloon and card wherein an individual balloon and greeting card are packaged in a packaging envelope that facilitates display of the balloon and greeting card to potential purchasers in a more effective mass merchandising manner using the envelope itself, or a container adapted to receive the envelope, as a display device.

Still another object of the present invention is to provide a packaged balloon and greeting card wherein the balloon and card are packaged in a packaging envelope in a manner to permit in-situ inflation of the balloon in the envelope so as to burst the envelope and thereby facilitate separation (unpackaging) of the balloon, the attendant tether line and greeting card for use by the purchaser.

Yet a further object is the provision of a balloon and coordinated greeting card with matching graphics, manufactured, marketed, stored, displayed, and sold as a composite unit, where upon inflation of the balloon, the card acts as the weight for the balloon.

SUMMARY OF THE INVENTION

The present invention contemplates a packaged balloon and greeting card comprising a balloon having an uninflated body, a filler neck extending from the body, and a first image displayed on the body; a greeting card having a face displaying a second image matching the first image; a tether line having a first end attached to the filler neck and a second end attached to the greeting card; and a packaging envelope receiving the uninflated balloon body, the greeting card and at least a portion of the tether line. A third image, matching the first and second image, may also be displayed on the packaging envelope.

The packaging envelope can include an opening through which the balloon filler neck or valve extends outside the envelope for communication to a source of inflating gas to permit in-situ inflation of the balloon body in the envelope.

The envelope can also be constructed so as to be burst by inflation of the uninflated balloon body while it resides in the envelope to facilitate unpackaging of the balloon for use. The packaging envelope is preferably constructed of paper material that is sufficiently thin to be burst by inflation of the balloon body. Further, the greeting card, when attached to the inflated balloon by a tether line, can additionally operate as the holding weight for the balloon.

Still further, the packaged balloon and greeting card can be placed in a suitable display container, such as a display box or sleeve, for display at a retail location. Either the packaged balloon and greeting card can be displayed, for example, in greeting card type racks for customer viewing and selection prior to inflation.

The aforementioned objects and advantages of the invention will become more readily apparent from the following detailed description taken with the following drawings.

DESCRIPTION OF THE DRAWINGS

FIG. 1 is a front elevational view of a packaged balloon and card in accordance with one embodiment of the invention.

FIG. 2 is a rear elevational view of the packaged balloon and card of FIG. 1.

FIG. 3 is a perspective view of the packaged balloon of FIG. 1 with the balloon body partially inflated to achieve bursting of the envelope.

FIG. 4 is similar to FIG. 3 after the balloon body is fully inflated and the card is visible.

FIG. 5 is an exploded perspective view showing the packaged balloon and card, and a display box for receiving the packaged balloon and card.

FIG. 6 is a perspective view illustrating folding of the paper material about the balloon body and card to form the packaging envelope.

FIG. 7 is an elevational view of a packaged balloon and card in accordance with still another embodiment of the invention wherein the packaging envelope is perforated at selected regions to facilitate bursting of the envelope during balloon inflation.

FIG. 8 is an elevational view of a packaged balloon and card in accordance with another embodiment of the invention wherein the envelope includes a transparent window through which the balloon body or card can be viewed by a potential purchaser.

FIG. 9 is a perspective view of an inflated balloon, an attached tether and greeting card, a non-bursting envelope, and a display container all having matching images.

DETAILED DESCRIPTION OF THE INVENTION

Figure 10:
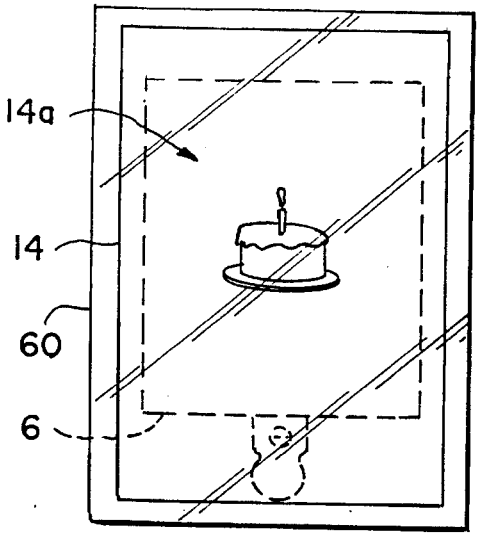
FIG. 10 is a front elevational view of a combination greeting card with a balloon packaged inside the card and a clear plastic shrink wrap coating sealing and covering the card and balloon.

FIGS. 1–2 illustrate a packaged balloon 2 in accordance with one embodiment of the invention. The packaged balloon 2 includes a balloon 4 having an uninflated, folded body 6 and a filler neck 8 extending from the folded balloon body 6 in usual fashion. The balloon 4 is shown in FIGS. 1–4 for purposes of illustration as a metallized plastic balloon (e.g., an aluminized Mylar plastic sheet) of well known construction showing a first image 6*a* of a birthday cake. However, the invention is not so limited and can be practiced using other types of balloons, such as a non-metallized latex balloon, or showing other images.

The flat filler neck 8 includes a gas entry opening 10, such as part of a filler valve, on one side adapted to be communicated to a well-known source of inflating gas, such as a pressurized helium cylinder (not shown), in order to inflate the balloon body 6. A valve (not shown) such as of the type shown in U.S. Pat. No. 4,917,646 can be disposed within the filler neck 8 so as to expose the valve's opening as gas entry opening 10, and is operable to permit inflation of the balloon body 6 to a prescribed inflation pressure and maintain the inflation pressure over time.

The packaged balloon 2 includes a balloon tether line 12 having an end length 12*a* connected to the other side of the flat filler neck 8 by, for example, adhesive such as a pressure sensitive or general purpose adhesive like 3M 464 aggressive adhesive. A free portion 12*b* of the tether line 12 proximate the end length 12*a* is folded back upon itself so as to extend into the envelope 20. The tether line 12 is shown for purposes of illustration as an elongated plastic ribbon connected to the balloon filler neck 8. Alternate tether line materials can include string or strong thread, for example.

A greeting card 14 is connected to the free end 12*c* of the tether line 12 by tying or use of adhesive, for example. It will be noted that free end 12*c* may be connected to any portion of card 14 and is not limited by the particular connection illustrated in the figures. The greeting card is shown for purposes of illustration as a rectangular card having a second image 14*a* on its face shown as a birthday cake. Image 14*a* can be any decorative shape or graphic, however, it is preferable that the second image 14*a* match, i.e., be identical, coordinated, or complimentary to, the first image 6*a* disposed on the body of the balloon. The tether line 12 and the greeting card 14 are typically retained between the fold 6*b* of the folded balloon body 6 as shown best in FIG. 6. The balloon body 6, tether line 12, and greeting card 14 are thereby packaged as a convenient, self-displaying unit in a packaging envelope 20.

The present invention contemplates the packaging of balloon 4, tether line 12, and card 14 in one envelope, however, the invention is not so limited, in that it may be practiced by packaging balloon 4 and greeting card 14 in one envelope without the tether line 12. Preferably, balloon 4 and card 14 have matching images 6*a* and 14*a*, however, the invention is also not limited in this respect. The invention also does not require the use of a tether line which connects the balloon and card, and thereby allows the card to be a holding weight for the inflated balloon, however, it has been found that such a structure is preferable for reasons discussed below.

Packaging balloon 4, tether line 12, and card 14 together in one envelope 20 is advantageous in that when the balloon is inflated, card 14 can act as a weight member reducing the tendency of the balloon to fly away. This is quite useful when balloon 4 is inflated with a lighter-than-air medium. Greeting card 14 can include an additional weight means shown as a weight member 14*d* in FIG. 4. The weight means can include a strip of heavy paper or cardboard, a lead tape, a plastic bar, or any other object which will increase the weight of the card. Preferably, the total weight of the card, tether line, and any weight means will be equal to or greater than the buoyancy of the helium-filled balloon. Accordingly, the total weight will vary with different size balloons, but can be readily determined from either the volume of the balloon or by simply experimenting with differently sized and weighted cards. It has been found that for an 18-inch round helium-filled metallized non-latex balloon that a total weight of the greeting card, tether line, and weight means is preferably within the range of 6 to 10 grams. When the total weight exceeds the buoyancy effect of the balloon, the card and weight member will prevent the balloon from flying away. This is especially advantageous when the balloon is first inflated because if the balloon is released, it will float away or until it hits an object such as a ceiling. Once this occurs, a person typically cannot easily recapture the balloon without difficulty.

The packaging envelope 20 preferably is constructed of a sheet-type packaging material, which is folded or otherwise configured to form a relatively thin, flat envelope configuration that resembles a letter or greeting card envelope. To this end, the envelope 20 includes a flat front face 22 and a flat rear face 24 having respective peripheral sides 22*a,b,c,d;* 24*a,b,c,d,* (see FIG. 6) joined together (in a manner to be described hereinbelow) to form an internal chamber or pouch therein for receiving balloon body 6, tether line 12, and greeting card 14.

Packaging envelope 20 may be constructed of any configuration which will contain the balloon, tether and card, however, it is advantageous to construct packaging envelope 20 in a bursting envelope. Such a bursting construction is described below.

Referring to FIGS. 1–2, the packaging envelope 20 includes an opening 26 defined between peripheral sides 22*a,* 24*a.* The balloon filler neck 8 extends through the opening 26 for communication of the filler neck 8 to the aforementioned source of inflating gas. The end length 12*a* of the tether line 12 attached (adhered) to the filler neck 8 as well as the folded-back portion 12*b* thereof also extend through the opening 26. The packaging envelope 20 is preferably constructed of thin paper sheet material that is sufficiently thick as to be formed into a suitable damage-resistant envelope, yet also sufficiently thin as to be burst by inflation of the folded balloon body 6 while it resides in the envelope 20. For example, tissue paper having a thickness in the range of about 0.0014 inch to about 0.004 inch can be used in practicing the invention to form an envelope which will burst upon balloon inflation. A particularly preferred paper material for constructing the envelope 20 comprises a tissue paper available from one of several manufacturers, such as Berwick Industries, and having a thickness of, but not limited to, 0.0015 inch.

Alternatively, thicker paper, thin metal foil, thin metallized paper or plastic, or other packaging material can be used to construct the envelope 20. In this situation, the envelope 20 could include suitable perforated regions 21 as shown, for example, in FIG. 7 that are selectively torn apart by inflation of the balloon body 6 in-situ in the envelope 20. That is, a line of weakening, such as a slit line 21, could be formed in the envelope 20 to permit the envelope, particularly if it is of a thicker paper or other hard to tear material, to tear apart with minimal effort, i.e., readily burst initially on that slit line 21 when the balloon body 6 is inflated.

In packaging the balloon 4 in the envelope 20 in accordance with the present invention, the uninflated balloon body 6 is folded into a compact shape and the card 14 is placed on a rectangular sheet of the tissue paper or in the balloonfold 6*b* described hereinabove, see FIG. 6. The sheet of paper includes adhesive, such as hot melt or pressure sensitive adhesive from 3M or any other manufacturer, deposited thereon at regions 30, 32 proximate the respective peripheral sides 22*a, b,c,d;* 24*a,b,c,d.* However, regions 34, 36 proximate the peripheral sides 22*a,* 24*a* do not include adhesive, i.e., they are free of adhesive.

The sheet of paper is folded about a fold line L and over the balloon body 6 and card 14 in the direction of the arrow in FIG. 6 until the adhesive regions 30, 32 contact and co-adhere to form the envelope 20 about the balloon body 6 and card 14. The adhesive-free regions 34, 36 are thereby placed in opposing relation and define the opening 26 through which the balloon filler neck 8 extends, or at least the opening 10 thereof.

To facilitate display of the particular balloon 4 and card 14 in the envelope 20 to potential purchasers at retail locations (e.g., retail stores), the front and/or rear face 22, 24 of the packaging envelope 20 can be printed with a third image 20*a* which matches the first image 6*a* on balloon 6 and the second image 14*a* on card 14. FIG. 1 illustrates the front face 22 so printed. Printing of such image graphics can be conducted before or after the paper material is folded to form the envelope 20. Alternately, a self-adhesive sticker (not shown) representative of the graphics and shape of the balloon 4 as packaged in the envelope 20 can be applied to the front and/or rear envelope face 22,24. Still further, the envelope 20 may possibly be constructed of paper material that is thin enough to render the balloon body 6 or card 14 contained in the envelope at least partially visible through the envelope material, to facilitate customer viewing at the retail level.

A further alternative for displaying the particular balloon 4 in the envelope 20 is illustrated in FIG. 8 where like reference numerals are used for like features of FIGS. 1–4. In this embodiment of the invention, the envelope 20 includes a window 40 in the front face 22 (and/or rear face 24) for viewing the balloon body 6 or card 14 in the envelope 20. The window 40 may comprise a transparent plastic, cellophane, or other material attached (e.g., adhered) to the envelope 20 over an opening 42 therein to permit viewing of the balloon body 6 or card 14.

The packaged balloon and card 2 described hereinabove is advantageous for convenient shipping, storing and displaying of the balloon and card to potential users at retail locations. For example, the balloon 4 and card 14 are packaged in the packaging envelope 20 which protects against dirt accumulation and damage to the balloon body 6 and card 14 during transport to the retail locations as well as during storage, handling, and displaying at the retail locations. Such protection is especially advantageous with respect to metallized plastic balloons to maintain their "shiny" appearance and to minimize damage to the relatively fragile metallized plastic material. The packaged balloon and card can be displayed readily on suitable display racks at retail stores in a manner analogous to that employed to display greeting cards, calendars, and the like If desired, the packaging envelope 20 can include a slot 20*b* by which the packaged balloon and card can be hung from display "hooks" in accordance with other commonly used mass merchandising techniques.

Moreover, as mentioned hereinabove, the packaging envelope 20 can include the window 40 and/or an image of the balloon 4 thereon to further facilitate display of product at the retail locations.

In addition, packaging of balloon 4, tether line 12, and greeting card 14 in the envelope 20 as a composite unit with matching graphics in accordance with the preferred embodiment of the invention avoids the need for the separate shipment, storage, display, and sale of these components as well as the need to fasten them to the balloon at the time of purchase and inflation at the retail location.

FIGS. 5 and 9 illustrate an embodiment of the invention wherein the packaged balloon 2 is placed in a display container 50, such as cardboard box or sleeve, for display at a retail location, such as in display racks. The display container 50 typically would bear a fourth image 50*a* matching the other images 6*a*, 14*a*, and 20*a*.

The packaged balloon 2 is also advantageous for subsequent unpackaging of the balloon and card for use. For example, once a purchaser selects a particular packaged balloon and card for purchase, the purchaser or a sales clerk at the retail store can readily inflate the balloon body 6 in-situ in the packaging envelope 20 by communicating the gas entry opening 10 of the balloon filler neck 8 to a pressurized helium gas cylinder or other source of inflating gas. Inflation of the balloon body 6 in the packaging envelope 20 causes the envelope to burst open to facilitate separation (unpackaging) of the balloon from the-envelope. FIG. 3 illustrates substantial bursting or tearing open of the packaging envelope 20 after partial inflation of the balloon body 6. FIG. 4 illustrates the burst envelope 20 after the balloon body 6 is completely inflated allowing card 14 to also separate from envelope 20. It is apparent that the inflated balloon 4 and card 14 are substantially separated or freed from the envelope 20 by the inflation operation. Typically, only a minor tearing away of the burst envelope 20 from the balloon filler neck 8 is needed to complete unpackaging of the inflated balloon 4 and card 14 from the envelope 20.

Inflation of the balloon body 6 in the envelope can be conducted in a staged manner. In particular, inflating gas (e.g., helium) is introduced initially to the balloon body 6 for a pre-set time period determined by a timed pneumatic gas flow valve and then, after expiration of the time period, the inflating gas is introduced to the balloon body 6 via a back pressure shut-off valve until a desired balloon inflation pressure is achieved. The initial timed inflation of the balloon body 6 is effective to achieve partial inflation, unfolding and bursting of the envelope 20. The subsequent back pressure-controlled inflation of the balloon body 6 is effective to achieve the desired full inflation pressure without bursting of the balloon body 6.

In FIG. 9, balloon 4, greeting card 14, packaging envelope 20, and display container 50 are all shown having matching images or graphics. First image 6*a*, second image 14*a*, third image 20*a* and fourth image 50*a* are all matching in that the graphics are coordinated, complimentary, and substantially similar to suggest a connection between each of the different components. Although in FIG. 9 the images are shown as being substantially the same, the images can vary somewhat as long as their appearances still suggest a coordinate link between the different components.

FIGS. 10 through 13 illustrate another embodiment of the present invention wherein the greeting card 14 acts as a protective cover for balloon body 6. Greeting card 14 is shown as having a front panel 14*b* connected to a back panel 14*c* along a fold line L. Balloon body 6 is disposed between the front and back panels to protect the balloon from damage during storage, shipping and display. Means are provided for sealing panels 14*b* and 14*c* about balloon 6. In FIG. 10, this means takes the form of a clear plastic wrapper 60. Wrapper 60 can either be of an envelope-type configuration wherein card 14 can be simply slipped into the envelope or alternatively, wrapper 60 can be a front and back panel of clear plastic heat sealed about their periphery to seal in and protect card 14.

Figure 12:
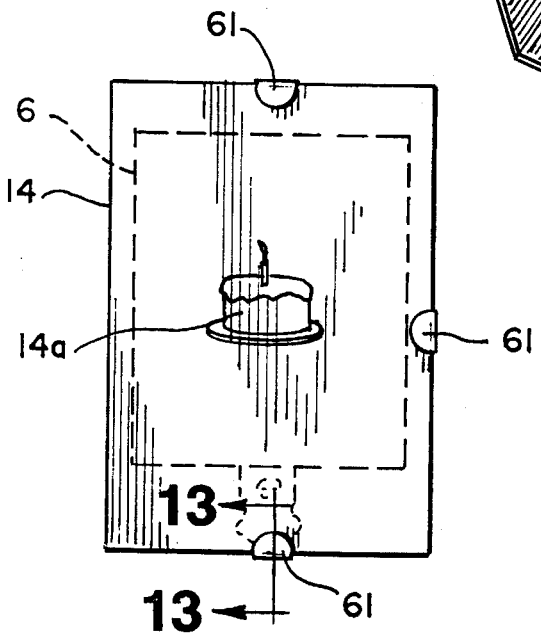
FIG. 12 is a front elevational view of a combination greeting card and balloon wherein the card is sealed about the balloon by a plurality of removable tabs.
Figure 13:
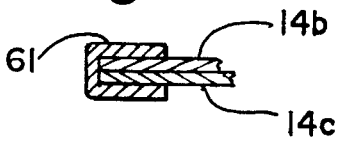
FIG. 13 is a cross-section taking at line 13—13.

FIGS. 12 and 13 illustrate an alternate means for sealing the panels 14*b* and 14c of the card about balloon body 6. This means takes the form of cut-away tabs 61 which are wrapped around the edges of the front and back panels at a plurality of locations. The embodiment shows three such tabs 61 disposed about the periphery of card 14 which effectively seal the panels 14*b* and 14*c* together, protecting the card from damage.

Figure 11:
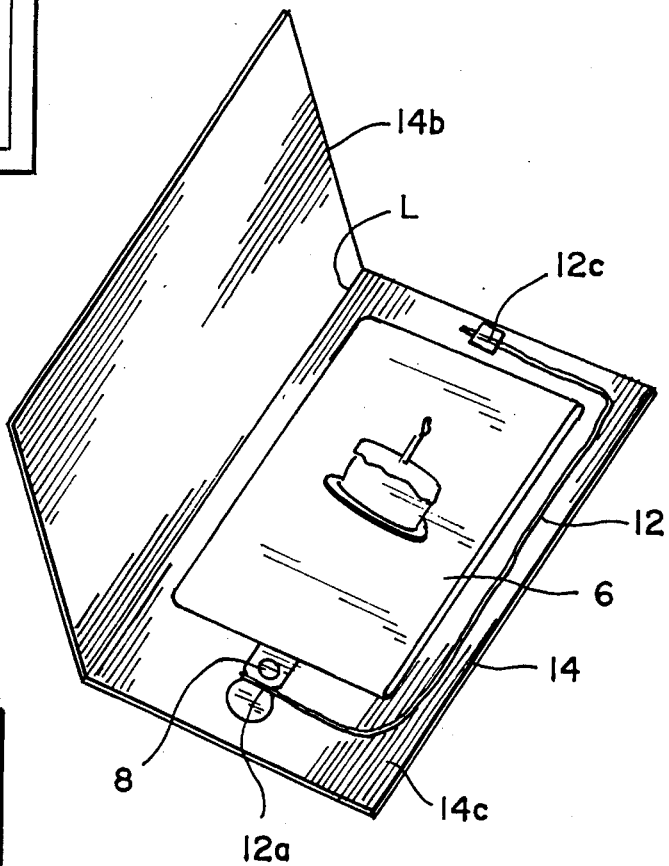
FIG. 11 is a perspective view illustrating the greeting card in an open position to show the balloon disposed therein.

As illustrated in FIG. 11, balloon body 6 can be connected, via a tether line 12 attached to filler neck 8, to card 14. As earlier described, an end length 12*a* can be tied, glued or taped to filler neck 8 and the free end 12*c* of the tether line can be similarly attached to any location on card 14.

It will be noted that in this embodiment, wherein card 14 acts as a protective cover for balloon body 6, that it is important that card 14 and balloon 6 have matching correlated images 14*a* and 6*a*. These matching images provide for a coordinate set of a matching greeting card and balloon which may be easily packed together for convenience of shipping, storage and display. It is also important to note that in this embodiment balloon 6 is preferably constructed of a material which will retain helium or other lighter-than-air fluids so as to render the balloon 6 inflatable, as earlier described.

The above described embodiments, wherein correlated greeting cards and balloons are packaged together, all have the advantage that there is no need to separately stock, display, and sell these components at a retail location and no need for the purchaser or sales clerk to fasten these articles together to create such a coordinated set. Consummation of the sale, unpackaging of the balloon, and use of the balloon are thus facilitated.

While the invention has been described in terms of certain embodiments thereof, it is not intended to be limited thereto but rather only to the extent set forth hereafter in the following claims.

We claim:

1. A packaged balloon and greeting card comprising:

a balloon having an uninflated body and a filler neck extending from said body;

a greeting card proximal said balloon; and a packaging envelope receiving said uninflated balloon body and said card, said packaging envelope having an opening through which said balloon filler neck extends outside said envelope for communication to a source of inflating gas, said envelope being so constructed as to be burst by inflation of said uninflated balloon body while it resides in said envelope, whereby unpackaging of said balloon from said envelope is facilitated.

2. The invention of claim 1 wherein said envelope is constructed of paper material.

3. The invention of claim 2 wherein said paper material has a thickness of about 0.0014 inch to about 0.004 inch.

4. The invention of claim 3 wherein said balloon comprises a metallized material.

5. A balloon and greeting card combination comprising:

a greeting card having a front panel attached to a back panel by a fold line;

a balloon having an uninflated body and a filler neck extending from said body, said balloon being constructed of a flexible, gas impervious material capable of retaining lighter-than-air media so that when said balloon is filled with said lighter-than-air media and in an inflated condition, said balloon is positively buoyant, said balloon being disposed between said front and back panels of said card;

a tether line having a first end attached to said filler neck and a second distal end attached to said card, said card receiving at least a portion of said tether line between said front and back panels;

a first image displayed on said balloon body and a second image displayed on a face of said greeting card, said first image matching said second image; and means for securing said front panel to said back panel about said balloon for protecting said balloon from damage.

6. The invention of claim 5 wherein said means for securing said front panel to said back panel comprises a clear plastic wrapper.

7. The invention of claim 5 wherein said means for securing said front panel to said back panel comprises a plurality of removable tabs.

8. The invention of claim 5 wherein said card acts as a weight member.

9. The invention of claim 8 wherein said greeting card has a weight exceeding a buoyancy of said balloon when said balloon is in an inflated condition.

10. The invention of claim 5 wherein said card includes weight means for preventing said balloon from rising when said balloon is an inflated condition.

11. The invention of claim 10 wherein said weight means includes one of a lead tape and a plastic bar.

12. A balloon and greeting card combination comprising:

a greeting card having a front panel attached to a back panel by a fold line;

a balloon having an uninflated body and a filler neck extending from said body, said balloon being constructed of a flexible, gas impervious material capable of retaining lighter-than-air media so that when said balloon is filled with said lighter-than-air media and is in an inflated condition, said balloon is positively buoyant, said balloon further being disposed between said front and back panel of said card;

a first image displayed on said balloon body and a second image displayed on a face of said greeting card, said first image substantially matching said second image;

a flexible tether line attached to at least said filler neck of said balloon and being at least partially disposed between said front and back panel of said card;

means for securing said front and back panel of said greeting card in a closed condition about said balloon for protecting said balloon from damage.

13. The invention of claim 12 wherein said balloon is comprised of a metallized material.

14. The invention of claim 12 wherein said means for securing said front and back panel in a closed condition comprises a clear plastic wrapper.

15. The invention of claim 12 wherein said means for securing said front and back panel in a closed condition comprises attachment means secured to distal edges of said front and back panel of said greeting card for holding said distal edges together.

16. The invention of claim 15 wherein said attachment means comprises a plurality of removable tabs.

17. The invention of claim 12 wherein said means for securing said front and back panel in a closed condition comprises a packaging envelope which receives said balloon, said greeting card, and said tether line.

18. The invention of claim 17 wherein said packaging envelope has an outer surface displaying a third image which substantially matches said first and second images.

19. The invention of claim 12 wherein said greeting card has a weight greater than the positive buoyancy of said balloon when it is in the inflated condition.

20. A packaged balloon and card combination comprising:

a balloon having an uninflated body and a filler neck extending from said body, said balloon being comprised of a metallized material and being constructed so that it will retain lighter-than-air media such that when the balloon is filled with lighter-than-air media and is in an inflated condition, said balloon is positively buoyant;

a card having a front panel and a back panel, said balloon being disposed between said front and back panel of said card for protecting said balloon from damage;

a first image displayed on said balloon body and a second image displayed on said card, said first image substantially matching said second image;

a packaging envelope receiving said uninflated balloon and said card with said balloon disposed between said front and back panels of said card; and a tether line having at least one end attached to said filler neck of said balloon and being at least partially disposed between said front and back panel of said card.

* * * * *